United States Patent [19]

Kurita et al.

[11] 4,003,335

[45] Jan. 18, 1977

[54] DEVELOPING MATERIAL APPLICATOR

[75] Inventors: Takaji Kurita, Kawachinagano; Takao Fujiwara, Sakai, both of Japan

[73] Assignee: Minolta Camera Kabushiki Kaisha, Osaka, Japan

[22] Filed: Apr. 28, 1975

[21] Appl. No.: 572,292

[30] Foreign Application Priority Data

May 21, 1974 Japan ..... 49-57540

[52] U.S. Cl. ..... 118/658; 118/655

[51] Int. Cl.[2] ..... G03G 15/09

[58] Field of Search ..... 355/3 DD; 427/18; 118/637

[56] References Cited

UNITED STATES PATENTS

| | | | |
|---|---|---|---|
| 3,145,122 | 8/1964 | Streich, Sr. | 118/637 |
| 3,399,652 | 9/1968 | Gawron | 118/637 |
| 3,784,297 | 1/1974 | Ito et al. | 118/637 |
| 3,872,829 | 3/1975 | Rattin | 118/637 |
| 3,881,446 | 5/1975 | Kurita et al. | 118/637 |
| 3,882,823 | 5/1975 | Tanaka et al. | 118/637 |
| 3,883,240 | 5/1975 | Ito et al. | 118/637 |

*Primary Examiner*—Mervin Stein
*Assistant Examiner*—Douglas Salser
*Attorney, Agent, or Firm*—Wenderoth, Lind & Ponack

[57] ABSTRACT

A developing material applicator for use in a photoelectrostatic copying machine to apply or depost a uniform layer of toner particles on the electrostatic latent image carried on a photoreceptor surface. The developing applicator comprises a housing structure having two compartments divided by a partition wall. Within a first one of the compartments, there is provided an impeller and a supply roll assembly for transferrence of the developing material from the first one of the compartments to the other second compartment. Within the second compartment and adjacent the supply roll assembly, there is positioned a clipping roll assembly for clipping the developing material carried by the supply roll assembly. An applicator is positioned within the second compartment at a developing zone where the photoreceptor surface is moved. The applicator applies the developing material over the photoreceptor surface after it has received the developing material from the clipping roll assembly.

7 Claims, 3 Drawing Figures

DEVELOPING MATERIAL APPLICATOR

Figure 1:
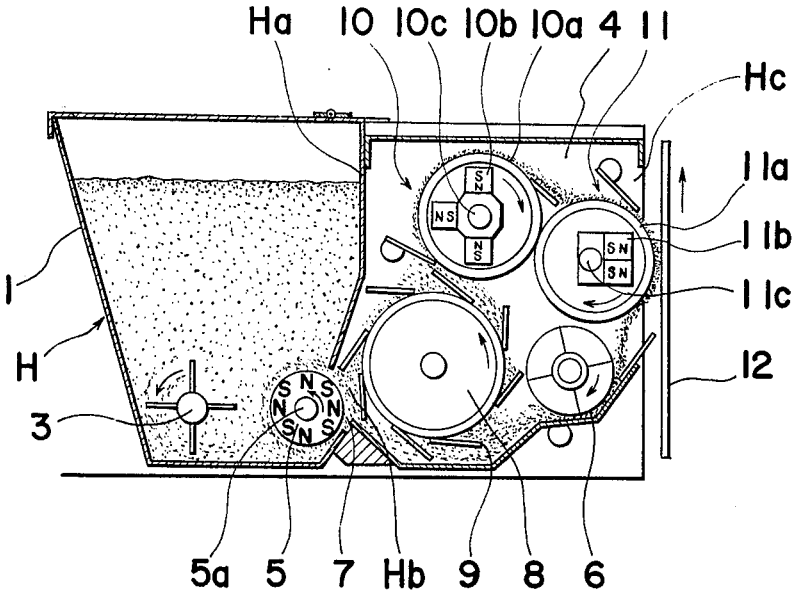

The present invention relates to an applicator for use in presenting a powdered developing material against the surface of an article for application thereto and, more particularly, to a magnetically responsive powder applicator for use in a photoelectrostatic copying machine for applying finely divided particles over the photoreceptor surface to cause the particles to electrostatically adhere to the photoreceptor surface to form a powdered image in the configuration of an electrostatic latent image previously developed on the photoreceptor surface.

In most photoelectrostatic copying machines, there is employed an applicator for applying a finely divided electroscopic developing material, known as "toner", over the photoreceptor surface. The applicator is generally positioned at a developing station at which the toner particles having an electrostatic charge opposite in polarity to that of the electrostatic latent image previously formed on the photoreceptor surface are applied over said photoreceptor surface whereby the toner particles adhere to the electrostatic latent image to form a powdered image in the configuration of the original to be copied. The photoreceptor surface may be in the form of either a rotary drum or a substantially endless belt.

The known toner applicator comprises a substantially box-like container or tank positioned above the developing station for accommodation of a mass of toner particles therein and has a slit, or a like opening, formed at the bottom thereof above and in spaced relation to the photoreceptor surface. The toner tank includes a rotary dispenser housed for rotation within the toner tank and extending in parallel relation to the slit or the like opening at the bottom of said toner tank. The rotary dispenser is in the form of either a rotary brush or a screwed stud similar in shape to a screw conveyor and, during operation thereof, acts to dispense the toner particles from the interior of the toner tank over the photoreceptor surface through the slit or the like opening in the form of cascading flow.

The toner applicator of the known construction referred to above has various disadvantages. For example, because of the particular construction of the toner applicator, it cannot be disposed anywhere as desired other than above the photoreceptor surface and, in addition, the toner particles downwardly flowing from the toner tank through the bottom slit tend to catch up with foreign particles which may ultimately constitute a cause for stains which may appear on the finished, or reproduced, recording sheet. Moreover, since adjustment of the amount of toner particles to be dispensed has been carried out by adjusting the rotation of the rotary dispenser, the amount of the toner particles to be applied by the dispenser tends to vary depending on the condition of the developing material within the toner tank. This often prevents uniform development in relation to the electrostatic charge carried by the latent image and, accordingly, the resultant image reproduced on the recording sheet lacks a sharp contrast.

Accordingly, an essential object of the present invention is to provide a magnetically responsive powder applicator for use in a photoelectrostatic copying machine which applicator is capable of applying magnetically responsive, finely divided particles over the photoreceptor surface in a substantially uniform and stable amount, with substantial elimination of the foregoing disadvantages inherent in the conventional applicator of a similar kind.

Another object of the present invention is to provide a magnetic powder applicator, which can, therefore, uniformly deposit thermally fusible resinous particles on the photoreceptor surface to ensure formation of a sharp powdered image thereon.

A further object of the present invention is to provide a magnetically responsive powder applicator, which can be disposed in any position as desired relative to the photoreceptor surface.

In order to accomplish the foregoing objects of the present invention, the present invention features magnetic attraction utilized in transporting the developing material which is a mixture of magnetizable carrier beads and toner particles. The toner tank is, according to the present invention, divided into two compartments communicating with each other through an opening formed adjacent the bottom thereof in a partition wall; one compartment adapted to accommodate a mass of the developing material and the other compartment adapted to operatively accommodate means for transferring the developing material onto the photoreceptor surface.

Figure 2:
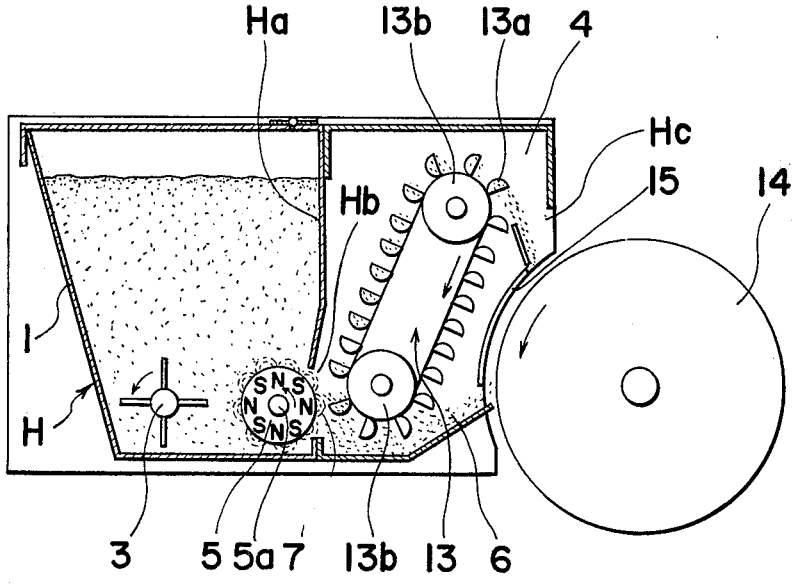
Figure 3:
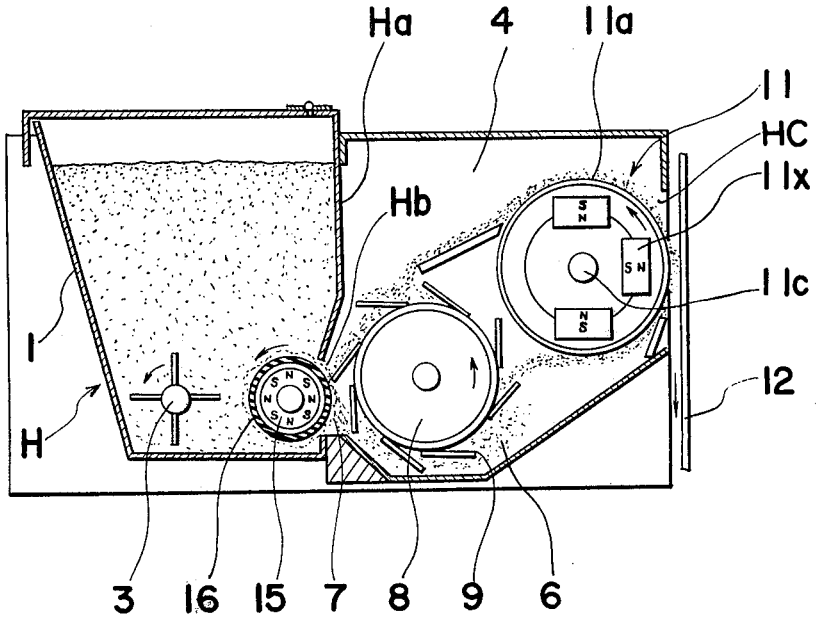

These and other objects and features of the present invention will become apparent from the following description taken in conjunction with preferred embodiments thereof with reference to the accompanying drawings, in which:

FIG. 1 is a schematic sectional elevational view of a magnetically responsive powder applicator according to one embodiment of the present invention, and FIGS. 2 and 3 are similar views to FIG. 1, showing other embodiments of the present invention.

Before the description of the present invention proceeds, it should be noted that like parts are designated by like reference numerals throughout the accompanying drawings.

Referring now to FIG. 1, there is shown a developing assembly comprising a substantially box-like housing H having the interior divided into two compartments 1 and 4 by means of a partition wall H*a*, which compartments 1 and 4 are in communication with each other through a substantially rectangular opening H*b* adjacent the bottom of the housing H. The opening H*b* may either be formed in the partition wall H*a* or be provided by making the partition wall H*a* terminate adjacent the bottom of the housing H. Alternatively, the housing H may comprise separate casings corresponding to the compartments 1 and 4, respectively.

The compartment 1 serves as a powder tank for accommodating a mass of finely divided toner particles while the compartment 4 serves as a chamber for accommodating mutually associated operative elements of the developing assembly as will be described in more details.

Within the compartment or powder tank 1, there is an impeller 3 supported for rotation in the direction as shown by the arrow and extending sidewise in parallel to the plane of a known photoreceptor surface 12, and a magnetic roll 5 having a consecutive portion of the outer periphery thereof situated within the compartment 4 through the opening H*b*, which magnetic roll 5 is positioned adjacent the bottom of the housing H and also the opening H*b* for rotation in the direction shown by the arrow and extends in parallel relation to the impeller 3. While the details of the magnetic roll 5 will subsequently be described, the impeller 3 is positioned so as to carry and throw the developing material within the powder tank 1 toward the magnetic roll 5 during rotation thereof.

The developing material employed in association with the applicator of the present invention is a mixture of known magnetizable carrier beads and known toner particles. However, it is to be noted that, as will be understood from the subsequent description of the present invention, while the toner particles are consumed during use of a copying machine and, therefore, must be supplied into the powder tank 1 each time the level of the toner particles within the powder tank 1 falls below a predetermined level, the carrier beads can be cycled within the housing and, therefore, need not be supplied as frequently as the toner particles. Accordingly, once the compartment 4 is supplied with the sufficient amount of mixture of carrier beads or iron beads and toner particles, only the toner particles need to be replenished thereafter.

The magnetic roll 5 comprises an elongated shaft 5*a* around which a plurality of alternately magnetically polarized elongated members, each having a substantially sector-shaped section, are rigidly positioned for rotation together with the shaft 5*a* coupled to a suitable drive motor (not shown) through a reduction gear train (not shown). Accordingly, it will readily be seen that, during rotation of the magnetic roll 5, magnetizable carrier beads magnetically attracted to the magnetic roll 5 and standing on the outer peripheral surface of said roll 5 as magnetic brush bristles 6 contact toner particles under friction and electrostatically attract the toner particles, as indicated by 7, whereby the toner particles are carried by the magnetic roll 5 along with the carrier beads for transference from one position within the powder tank 1 to another position within the compartment 4 through the opening Hb.

Rotatably positioned within the compartment 4 in the vicinity of that portion of the magnetic roll 5 which is exposed towards said compartment 4 through the opening H*b* is a clipping roll 8 having a plurality of clipping blades 9 secured to the outer periphery of said roll 8 in equally spaced relation to each other and outwardly extending therefrom in a substantially tangential direction and in a substantially opposite manner to the direction of rotation of the roll 8 shown by the arrow. More specifically, assuming that the magnetic roll 5 is adapted to rotate counterclockwise as indicated by the arrow, the clipping roll 8 is preferably rotated in the same direction so that the clipping blades 9 can, during rotation of the clipping roll 8, successively clip the magnetic bristles 7 formed by the carrier beads and the toner particles on the outer peripheral surface of the magnetic roll 5.

Though the magnetic bristles and, therefore, the developing material, which have successively been clipped by the clipping blades 9 on the clipping roll 8 tend, as the clipping roll 8 continues to rotate counterclockwise, to fall by gravity onto the bottom of the compartment 4, continued rotation of the clipping roll 8 causes the clipping blades 9 to successively scoop the developing material from the bottom of the compartment 4 towards an intermediate transfer sleeve assembly 10 which is positioned substantially above the clipping roll 8.

The intermediate transfer sleeve assembly 10 comprises a hollow cylinder or sleeve 10*a* made of nonmagnetizable material supported within the compartment 4 for rotation in the direction shown by the arrow and counter to the direction of rotation of the clipping roll 8. For rotating the sleeve 10*a*, a drive pulley (not shown) which may be coupled to the drive motor common to the magnetic roll 5 and the clipping roll 8 through the same or a different reduction gear train (not shown) may be contacted connected to the outer peripheral surface of said sleeve 10*a* adjacent one end thereof for transmitting a rotational force of said pulley to said sleeve 10*a*.

Within the sleeve 10*a*, there is mounted a plurality of alternately polarized magnetic bars 10*b* rigidly mounted on a non-rotatable shaft 10*c* in spaced relation to each other. These magnetic bars 10*b* are positioned relative to the sleeve 10*a* such that the developing material successively transferred from the bottom of the compartment 4 to a position substantially immediately below the sleeve assembly 10 is picked up by the sleeve 10*a* by the effect of magnetic attraction exerted by one of the magnetic bars 10*b* positioned close to said clipping roll 8 and, then transferred, during rotation of the sleeve 10*a*, towards a position adjacent an applicator roll assembly 11 while the particles constituting the developing material tumble on the outer peripheral surface of the sleeve 10*a* under the effects of the changing directions of the magnetic fields respectively produced by the magnetic bars 10*b*. The particles constituting the developing material form magnetic brush bristles on the outer peripheral surface of the sleeve 10*a* even during transference thereof towards the position adjacent the applicator roll assembly 11. More specifically, in the illustrated embodiment of FIG. 1, since the applicator roll assembly 11 is positioned adjacent a developing window Hc formed in a wall member of the housing H in opposite relation to the partition wall Ha and at a position laterally adjacent the intermediate sleeve assembly 10 while the latter is positioned substantially intermediate between the partition wall H*a* and said applicator roll assembly 11, two of the magnetic bars 10*b* are approximately 180° spaced from each other about the axis of the shaft 10*c* while the other magnetic bar 10*b* is positioned approximately 90° spaced from one of said two magnetic bars 10*b*, which is the closest to the clipping roll 8, and preceding the other of said two of the magnetic bars with respect to the direction of rotation of the sleeve 10*a*.

The applicator roll assembly 11 is constructed in a substantially similar manner as the intermediate sleeve assembly 10 and comprises a sleeve or hollow cylinder 11*a* of nonmagnetizable material supported for rotation in the direction as indicated by the arrow and in a direction counter to the direction of rotation of the sleeve 10*a*. For effecting rotation of the sleeve 11*a*, the drive pulley, which has hereinbefore been described as used to rotate the intermediate sleeve 10*a* in contact therewith, may also be contacted to the outer peripheral surface of said sleeve 11*a*. Alternatively, while the drive pulley referred to above is drivingly engaged to one of the sleeves 10*a* and 11*a*, the other sleeve 11*a* or 10*a* may be arranged so as to receive a rotational force of said drive pulley as transmitted through said one of said sleeves 10*a* and 11*a*. In any event, the sleeve 11*a* is positioned such that a portion of the outer peripheral surface of said sleeve 11*a* is exposed to the outside of the compartment 4 through the developing window Hc and terminates in the close vicinity of the photoreceptor surface 12, which is in the illustrated embodiment of FIG. 1 a portion of a substantially endless belt movable in the direction indicated by the arrow.

Within the sleeve 11*a*, there is at least one magnetic bar 11*b* rigidly mounted on a non-rotatable shaft 11*c* supported in position within the compartment 4. The magnetic bar 11*b* is positioned relative to the sleeve 11*a* such that the developing material carried by the sleeve 10*a* being rotated in the manner as hereinbefore described can be picked up by the sleeve 11*a* by the effect of magnetic attraction exerted by said magnetic bar 11*b* forming magnetic brush bristles on the outer peripheral surface of the sleeve 11*a* in a substantially identical manner as those formed on the outer peripheral surface of the sleeve 10*a*. The developing material thus transferred onto the sleeve 11*a* is carried past the developing window Hc to a point where the carrier beads will no longer be held under the influence of the magnetic field developed by the magnetic bar 11*b* and, consequently, drop off the sleeve 11*b* and back to the bottom of the housing H in a manner as indicated by 6.

As is well known to those skilled in the art, the magnetic brush bristles carried on the sleeve 11*a* contact, as they pass in front of the developing window Hc, consecutive portions of the photoreceptor surface 12 having an electrostatically charged latent image opposite in polarity to that of the toner particles so that the latter can be attracted to the photoreceptor surface 12 to develop a powdered image in the configuration of the latent image and, hence, the original to be copied. At this time, the carrier beads remain attracted to the outer peripheral surface of the sleeve under the influence of the magnetic field developed by the magnetic bar 11*b* until they reach the point where they come out of said magnetic field.

In the embodiment shown in FIG. 2, the developing assembly within the compartment 4 of the housing H is designed so as to apply developing material in a cascading flow over the photoreceptor surface. For this purpose, a known bucket conveyor 13 is employed. Since the construction of the bucket conveyor 13 itself is well known, the structural details thereof are herein omitted and the bucket conveyor 13 will now be described in terms of its function within the compartment 4.

During operation of the bucket conveyor 13 moving in the direction indicated by the arrow in FIG. 2, the magnetic brush bristles formed on the outer peripheral surface of the magnetic roll 5 are successively clipped by buckets 13*a* of the conveyor 13 in a substantially similar manner as they are clipped by the clipping blades 9 in the foregoing embodiment of FIG. 1. The carrier beads and toner particles (the developing materials) are carried by the buckets 13*a* upwardly and, as the buckets turn around one of the support rolls 13*b* which is positioned above the other of the support rolls 13*b*, are thrown through the developing window Hc onto the photoreceptor surface which, in the embodiment of FIG. 2, is a portion of the peripheral surface of a photoreceptor drum 14. The developing material which has been cascaded over the photoreceptor surface 14 flows in contact with the outer peripheral surface of the photoreceptor drum 14 and, at this time, the toner particles are attracted to the electrostatically charged latent image on the photoreceptor surface in the known manner while the carrier beads are recovered in the bottom of the housing H.

Positioned in the vicinity of the photoreceptor surface 14 and substantially in the plane of the developing window Hc is an elongated plate electrode 15 of arched shape in section to which an electrical potential having a polarity opposite to the electrostatic charge carried by the latent image on the photoreceptor surface is to be applied thereby cancelling an electrical potential carried by the other portion of the photoreceptor surface than the latent image. Application of the electrical potential to the plate electrode 15 is advantageous in that sharp reproduction of the image of the original to be copied can ultimately be obtained on a web of sheet, for example, recording paper.

Referring to FIG. 3, shown there is an embodiment of the present invention wherein the developing material carried by the clipping roll 8 is directly transferred to the applicator roll assembly 11. More particularly, in the embodiment of FIG. 3, the intermediate sleeve assembly 10 employed in the foregoing embodiment of FIG. 1 is omitted.

In the embodiment of FIG. 3, the applicator roll assembly 11 has three magnetic bars 11*x* rigidly mounted on the fixed shaft 11*c* in spaced relation to each other about said shaft 11*c*. It should be noted that a similar considration as has been paid in connection with the positioning of the magnetic bars 10*b* in the embodiment of FIG. 1 should be paid in connection with positioning of the magnetic bars 11*x* relative to the sleeve 11*a*. Moreover, due to the orientation of the clipping blades 9 on the clipping roll 8, the sleeve 11*a* in the embodiment of FIG. 3 is adapted to be rotated counterclockwise as indicated by the arrow while the photoreceptor surface 12 is correspondingly adapted to be moved downwards as indicated by the arrow and in a direction counter to the direction of the rotation of the sleeve 11*a*.

A magnetic cylinder 15, which corresponds to the magnetic roll 5 of FIG. 1 and is constructed in a substantially similar manner as said magnetic roll 5 of FIG. 1, is non-rotatably supported by the housing within the compartment 1. Positioned around said magnetic cylinder 15 is a rotatable sleeve 16 supported in a similar fashion to the sleeve 11*a*. The assembly including the magnetic cylinder 15 and the sleeve 16 functions in a manner substantially similar to the magnetic roll 5 employed in any of the embodiments of FIGS. 1 and 2.

From the foregoing full description of the present invention, it has now become clear that, since a rotatable supply means, such as the magnetic roll 5 or the magnetic cylinder 15, is employed, the developing assembly can be arranged in any position lateral, above or below the powder tank 1. It is also clear that the magnetizable carrier beads are so circulated within the housing H that a fresh mass of carrier beads need not be frequently supplied into the housing H.

From the foregoing description and with reference to the accompanying drawings, it is also clear that various changes and modifications are apparent to those skilled in the art. By way of example, the magnetic roll 5 which has been described as employed in the embodiments of FIGS. 1 and 2 may be replaced by the assembly including the magnetic cylinder 15 and the sleeve 16 which has been described as employed in the embodiment of FIG. 3. Alternatively, the assembly including the magnetic cylinder 15 and the sleeve 16 of FIG. 3 may be replaced by the magnetic roll 5 of FIGS. 1 and 2. Furthermore, the sleeve 16 may be fixed, in which case the magnetic cylinder 15 should be designed so as to rotate with the shaft.

Accordingly, these changes and modifications are to be understood as included within the true scope of the present invention unless they depart therefrom.

What is claimed is:

1. An apparatus for use in a photo-electrostatic copying machine for delivering toner particles carried by magnetizable carrier beads to develop an electrostatic latent image formed on an image-receiving surface, said apparatus comprising:

first compartment means within said copying machine for containing therein only said toner particles;

second compartment means adjacent said first compartment means for containing a mixture of said toner particles and said carrier beads therein, said compartment having a first opening into said first compartment means and a second opening adjacent said image receiving surface;

applicator means within said second compartment means adjacent said second opening for developing the electrostatic latent image formed on said image receiving surface; and a rotatable replenishing means between said first opening and said applicator means for removing said toner particles from said first compartment means and contacting said toner particles with said carrier beads contained in said second compartment means, for delivering said toner particles and carrier beads to said applicator means, and for recirculating said carrier beads within said second compartment means to said toner particles coming from said first compartment means after said toner particles and carrier beads are delivered to said applicator means.

2. An apparatus as claimed in claim 1 wherein said rotatable replenishing means is comprised of a magnetic member disposed between said first and second compartments adjacent said applicator means whereby said magnetic member attracts said magnetizable carrier beads thereon and forms magnetic brushes for said toner particles from said first compartment.

3. An apparatus for use in a photoelectric copying machine for delivering toner particles attracted to magnetizable carrier beads to develop an electrostatic latent image formed on an image-receiving surface, said apparatus comprising:

a housing structure having a partitioned wall therein dividing said structure into a first compartment for containing only a mass of said toner particles therein and a second compartment containing only a mixture of said magnetizable carrier beads and said toner particles, said partition wall having a first opening therein between said first and second compartments and said second compartment having a second opening therein adjacent said image receiving surface;

applicator means within said second compartment adjacent said second opening for developing the electrostatic image formed on said image receiving surface;

a rotating magnetic supply means operatively positioned at said first opening between said first and second compartments for attracting said magnetizable carrier beads and forming magnetic brushes for transferring said toner particles from said first compartment into said second compartment; and recirculatory transporting means within said second compartment between said magnetic supply means and said applicator means for transporting said toner particles transferred by said magnetizable carrier beads to said second compartment to said applicator means and for recirculating said magnetizable carrier beads between said applicator means and said supply means.

4. An apparatus as claimed in claim 3 wherein said magnetic supply means is comprised of a stationary magnetic member and a rotatable sleeve surrounding said magnetic member.

5. An apparatus as claimed in claim 3 wherein said magnetic supply means is comprised of a rotatable magnetic roll.

6. An apparatus as claimed in claim 3 wherein said recirculatory transporting means is comprised of a clipping roll operatively rotatably positioned within said second compartment adjacent said magnetic supply means for successively clipping magnetic brush bristles on said rotating magnetic supply means and then transferring said magnetic brush bristles away from said magnetic supply means toward said applicator means.

7. An apparatus as claimed in claim 6 further comprising an intermediate roll assembly means operatively positioned between said clipping roll and said applicator means for transporting said toner particles and carrier beads and clipped from said magnetic supply means by said clipping roll toward said applicator means and for returning said magnetizable carrier beads from said applicator means to said magnetic supply means.

* * * * *